United States Patent [19]

Rameckers et al.

[11] 4,177,609

[45] Dec. 11, 1979

[54] AUTOMATIC BELT CENTERING DEVICE

[75] Inventors: Stephanus J. Rameckers, Terheijden; Peter Wanninkhop, Breda; Antonie J. Moolenaar, Dorst, all of Netherlands

[73] Assignee: Skil Corporation, Chicago, Ill.

[21] Appl. No.: 924,049

[22] Filed: Jul. 12, 1978

[51] Int. Cl.[2] ..... B24B 23/06

[52] U.S. Cl. ..... 51/170 EB; 51/135 BT

[58] Field of Search ..... 51/170 EB, 135 BT, 135 R, 51/142

[56] References Cited

U.S. PATENT DOCUMENTS

| | | | |
|---|---|---|---|
| 2,733,555 | 2/1956 | Dugle et al. | 51/135 BT |
| 3,029,568 | 4/1962 | Lubas | 51/170 EB |
| 3,094,819 | 6/1963 | Murschel | 51/170 EB |
| 3,497,336 | 2/1970 | Bushman | 51/170 EB |
| 3,665,650 | 5/1972 | Prygocki | 51/135 BT |
| 3,789,552 | 2/1974 | Bradbury | 51/170 EB |
| 3,900,973 | 8/1975 | Van der Linden | 51/135 BT |
| 3,971,166 | 7/1976 | Habeck | 51/135 BT |

*Primary Examiner*—Robert Louis Spruill
*Assistant Examiner*—Roscoe V. Parker
*Attorney, Agent, or Firm*—McDougall, Hersh & Scott

[57] ABSTRACT

An apparatus such as a belt sander including spaced apart rolls and adjustable mounting means for supporting at least one roll. An endless belt is positioned around the rolls and drive means are provided for the rolls and belt. Alignment means including a belt edge engaging means are operatively connected to the roll mounting means, and a resilient force is applied to hold the engaging means against a belt edge as the belt is moved by the drive means. This causes the engaging means to follow variations in the belt edge position, and this movement is transmitted to the mounting means whereby the variations are compensated.

10 Claims, 4 Drawing Figures

AUTOMATIC BELT CENTERING DEVICE

BACKGROUND OF THE INVENTION

1. Field of the Invention

This invention relates to an apparatus such as a belt sander. Structures of this type generally comprise opposed rolls which support an endless belt. A drive motor or the like is provided, and the motor may be directly associated with the structure to provide a portable apparatus.

The invention is more particularly concerned with means for maintaining the belt in proper alignment during use of the apparatus. Thus, it has been recongized that the endless belts employed tend to "wander" in one direction or the other during use, and the belt as well as the apparatus can be damaged if this is not controlled.

2. Description of the Prior Art

Structures such as belt sanders have been provided which include at least one adjustable roll so that the tendency for a belt to wander can be controlled to some extent. For example, if an operator observes belt movement, the apparatus can be turned off, and the adjustable supporting roll tilted to compensate for the tendency to wander. This can be an effective technique once the proper adjustments have been made; however, it is time-consuming and readjustments are frequently required in view of the rough handling which characterizes use of the apparatus.

Various attempts have been made to provide automatic belt centering means. Disclosures of structures developed by the prior art are set forth in the following patents:

Dugle, et al. U.S. Pat. No. 2,733,555
Lubas U.S. Pat. No. 3,029,568
Murschel U.S. Pat. No. 3,094,819
Przygocki U.S. Pat. No. 3,665,650
Bradbury, et al. U.S. Pat. No. 3,789,552
Van der Linden U.S. Pat. No. 3,900,973
Habeck, et al. U.S. Pat. No. 3,971,166

Murschel discloses a sanding machine which includes a pivotally mounted roller with guide rods for engaging opposite edges of the belts. Rocking movement of the roller supporting shaft is developed in response to belt edge engagement with the guide rods.

Dugle, et al. described a servo-tracking device which includes a finger 30 and tracking shoe 20 connected to a servo-mechanism. The tracking shoe is tilted in response to belt shifting from a desired position. Przygocki discloses a pneumatic system for oscillating the endless belt transversely of the rollers. An air stream directed against the moving belt edge acts as a sensor for determining edge variations.

The other references referred to are of general interest and are not considered as pertinent as the references described.

SUMMARY OF THE INVENTION

This invention generally relates to an apparatus of the type involving the provision of an endless belt mounted on spaced apart rolls. A typical application of the invention involves the utilization of a sanding belt in a portable sanding machine.

The construction includes means for adjusting the position of at least one of the rolls supporting the sanding belt. A drive motor or the like is connected to at least one roll, and means are provided for controlling the alignment of the belt relative to the rolls during operation of the apparatus.

The alignment means include a belt edge engaging means and resilient means connected to the adjustable roll mounting means. The roll mounting means and the engaging means are operatively connected so that the resilient means holds the engaging means in contact with a belt edge. As the belt edge tends to wander, the variations are detected by the engaging means, and the movement of the engaging means is transmitted to the mounting means. This serves to adjust the one roll supporting the belt to compensate for the variations.

In the preferred form of the invention, the adjustable roll supporting the belt comprises an idler roll. The mounting means for the idler roll comprise a fork structure with opposed fork arms rotatably supporting the adjustable roll. The resilient means operates to pivot the fork in direct response to the movement of the engaging means in contact with the belt edge. Accordingly, variations in the belt edge position are immediately detected and acted upon with the result that the belt will not wander to a degree sufficient to disrupt operation of the apparatus.

DESCRIPTION OF THE PREFERRED EMBODIMENT

Figure 1:
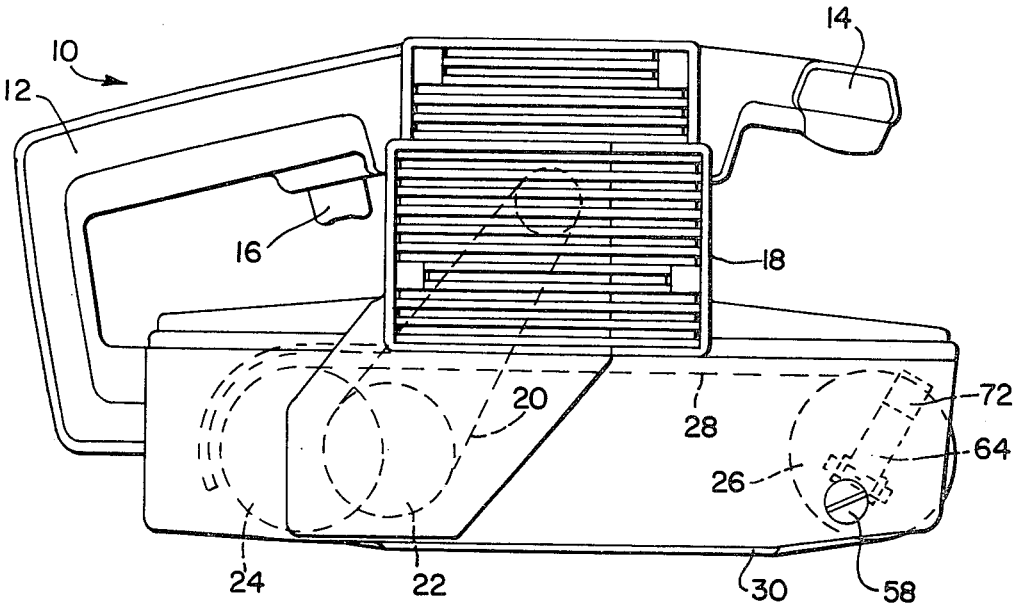
FIG. 1 comprises a side elevation of a belt sander characterized by the features of this invention.

The drawings illustrate a portable belt sander 10 including handle portions 12 and 14. An operating button 16 is employed for a drive motor located within housing 18. Drive belt 20 extends between the motor and drive member 22, this member being operatively connected to driven roll 24.

The roll 24 and idler roll 26 serve to support endless sanding belt 28. This belt carries abrasive on one surface and the belt is driven over lower plate 30. The belt is thus exposed whereby the abrasive will provide the desired sanding effect.

Idler roll 26 is mounted on a fork structure 32 which includes opposed arms 34. The ends of roll 26 are journalled to the arms 34 in any suitable fashion. When the drive motor is operated, the belt will serve as the means for transmitting rotary movement to roll 26.

The fork 32 includes a main body portion 36 defining slot 38. Avertically extending rod 40 is received by this slot, and thisrod is fixed to frame portion 42 which extends inwardly between the flights of the belt. The slot and pin arrangement provide for pivoting movement of the fork 32.

A lever including arms 44 and 46 is pivotally connected at 48 to the fork 32. Spring 50 has one end connected to inwardly extending portion 52 of the frame, and the other end of the spring is connected to arm 44. The spring normally urges the lever counterclockwise, and a tab 54 formed on the lever limits the lever movement relative to fork 32. The arrangement illustrated, therefore, serves to develop forces tending to pivot fork 32 counterclockwise about pin 40.

One arm 34 is engaged by the end 56 of threaded screw 58. Spring 60 extends between the head of the screw and the end portion 62 of member 64. This member is pivotally connected at 66 to a side wall 68 of the lower housing of the appartus.

The end portion 62 defines a threaded opening for receiving the screw 58 while the opening 70 defined by wall 68 freely receives the screw. Accordingly, rotation of the screw changes the distance that the screw extends outwardly relative to the end 62 of member 64.

The opposite end of the member 64 carries a disc 72 which is preferably formed of a highly wear-resistant material. This disc bears against the edge 74 of belt 28 during operation of the apparatus. Many suitable materials could be utilized for forming the disc including abrasion-resistant ceramic, carbide-containing, and plastic materials. It will be appreciated that the operation of the apparatus is not dependent upon the nature of the material employed; however, it is desirable to employ a material which will not require frequent replacement.

Figure 2:
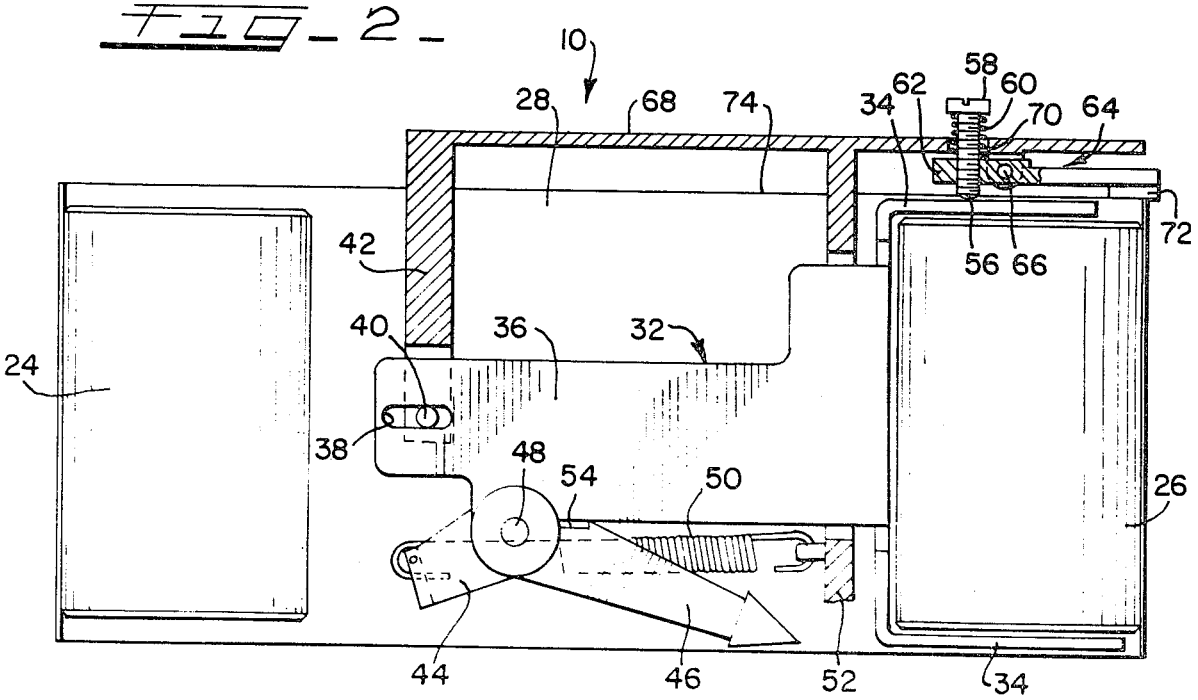
FIG. 2 is a horizontal sectional view of the belt sander illustrating the belt in desired alignment relative to the supporting rolls.
Figure 3:
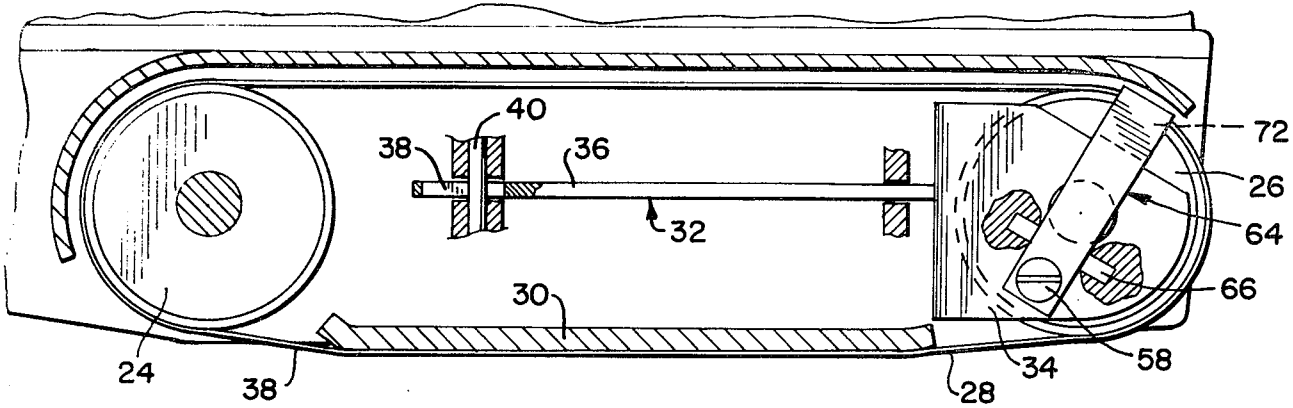
FIG. 3 is a fragmentary, vertical, sectional view of the apparatus.

In the operation of the construction, it is desirable to achieve a condition such as shown in FIG. 2 where the belt 28 is substantially centered relative to rolls 24 and 26. Under these conditions, the axis of the fork 32 is substantially parallel with the belt edges. The force applied by spring 50 develops a component of force in the arm 34 which is engaged by screw 58. This force component tends to move member 64 clockwise. An oppositely directed force is, however, applied against disc 72 due to its engagement with belt edge 74.

Figure 4:
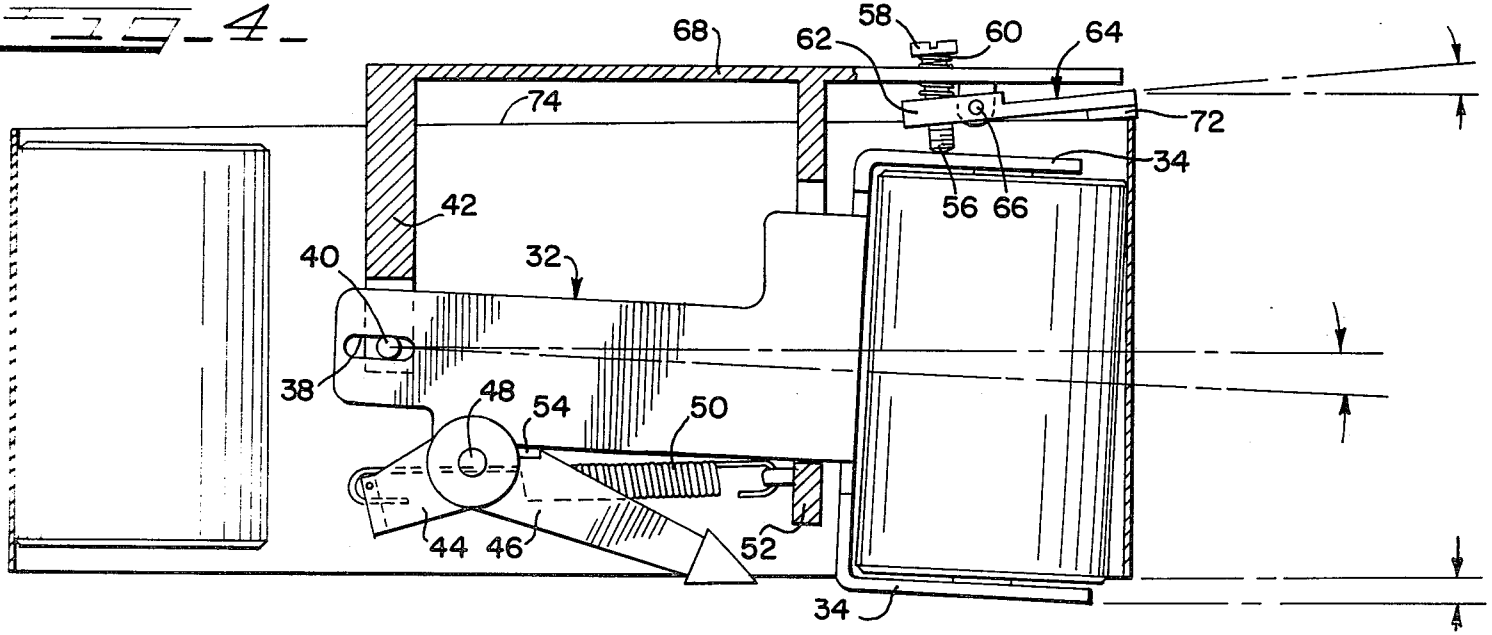
FIG. 4 is a horizontal, sectional view illustrating the belt out of alignment and illustrating the compensating features of the apparatus.

The force applied by spring 50 will cause the disc 72 to stay in engagement with the belt edge. In the event of any tendency of the belt to wander from the position shown in FIG. 2, the member 64 will pivot to follow the belt edge. This variation of the position of member 64 will result in a pivoting of fork 32 as shown in exaggerated form in FIG. 4. Thus, where the belt edge has wandered toward wall 68, the member 64 pivots counterclockwise thereby driving screw 58 against fork 32. This pivots the fork and tilts the axis of roll 26. The tilting of the axis will, in turn, affect the belt in a fashion such that the belt edge 74 will move away from the wall 68. As this occurs, the member 64 and screw 32 will return to the desired running position.

The provision of screw 58 enables an operator to make adjustments during use of the tool to eliminate any need for large compensating movements during operation. Thus, by varying the extent of screw 58 outwardly relative to member 64, the mechanisms can be calibrated to a condition such that the wandering can be virtually eliminated.

In addition to the pivoting force applied by spring 50, the spring provides a force component tending to urge roll 26 away from roll 24. With a belt in place and due to slot 38, this causes tension in belt 28 which is desirable during operation.

The provision of lever arm 46 permits release of the force applied by spring 50. Thus, by rotating the lever clockwise from the position shown in FIG. 2, the force applied to fork 32 is removed and this also removes the tension on the belt 28. This arrangement facilitates removal of the belt for replacement or maintenance purposes.

It will be understood that various changes and modifications may be made in the structure described which provide the characteristics of the invention without departing from the spirit of the invention particularly as defined in the following claims.

That which is claimed is:

1. In an apparatus including spaced apart rolls, an adjustable mounting means for at least one roll, an endless belt positioned on the rolls, and drive means for the rolls and belt, the improvement comprising means for maintaining the belt in alignment relative to said rolls, the alignment means including a belt edge engaging means defining an engaging surface for engaging one belt edge, resilient means connected to said mounting means for applying a force tending to drive the mounting means in one direction, a support for said engaging means, and means operatively connecting said support and said mounting means whereby the force applied by said resilient means is transmitted to said support and associated engaging means, said resilient means thereby applying pressure to said engaging means to hold the engaging surface against said one belt edge as the belt is moved by the drive means, said engaging means therefor following variations in the belt edge position, and the position of said mounting means therefor being adjusted in response to said variations to compensate for the variations.

2. An apparatus in accordance with claim 1 wherein said engaging means defines a wear resistant belt engaging surface, and wherein said support comprises a pivotally mounted support for the engaging means, variations in the belt edge position pivoting said support for movement of the support relative to said mounting means.

3. An apparatus in accordance with claim 2 including an adjusting screw threadably carried by said support, an end of said screw engaging said mounting means, rotation of the screw providing means for selecting a desired predetermined belt edge position, variations from said position resulting in adjustment of the mounting means to compensate for the variations.

4. An apparatus in accordance with claim 3 wherein said mounting means comprises a fork including a pair of arms, said one roll being rotatably supported between said arms, said screw end engaging one of said arms.

5. An apparatus in accordance with claim 4 including a main body portion of said fork for supporting said arms, and means pivotally supporting said main body portion.

6. An apparatus in accordance with claim 5 wherein said resilient means comprises a spring normally forcing said fork into engagement with said screw end.

7. An apparatus in accordance with claim 6 including a lever mounted on said main portion, said spring being connected to said lever for applying force to said fork, and including a manually engageable lever arm for pivoting the lever relative to the main body portion to release the spring force applied to the fork.

8. An apparatus in accordance with claim 1 comprising a belt sander.

9. An apparatus in accordance with claim 8 wherein said one roll comprises an idler roll, said sander comprising a pivotable sander including a housing, said drive means comprising a drive motor located within the housing, the other roll being connected to said motor.

10. An apparatus in accordance with claim 7 including a housing defining a wall portion extending inwardly between the flights of said belt, the means pivotally supporting said main body portion including a pin and a slot receiving the pin whereby the pin is movable axially of the slot, said spring tending to force said rolls apart thereby applying tension in said belt, release of the spring by said lever arm operating to relieve said tension.

* * * * *